US010565815B2

(12) United States Patent
Chou et al.

(10) Patent No.: US 10,565,815 B2
(45) Date of Patent: Feb. 18, 2020

(54) SELF-LOCKING CASH DEPOSIT EQUIPMENT AND CASHBOX THEREOF

(71) Applicant: MASTERWORK AUTOMODULES TECH CORP. LTD., Taipei (TW)

(72) Inventors: Hung-Hsun Chou, Taipei (TW); Wen-Hsien Tsai, Taipei (TW)

(73) Assignee: MASTERWORK AUTOMODULES TECH CORP. LTD., Taipei (TW)

( * ) Notice: Subject to any disclaimer, the term of this patent is extended or adjusted under 35 U.S.C. 154(b) by 82 days.

(21) Appl. No.: 15/866,024

(22) Filed: Jan. 9, 2018

(65) Prior Publication Data

US 2019/0213823 A1 Jul. 11, 2019

(51) Int. Cl.

| | |
|---|---|
| ***G07D 11/125*** | (2019.01) |
| ***G07F 9/06*** | (2006.01) |
| ***G07G 1/00*** | (2006.01) |
| ***G07F 19/00*** | (2006.01) |

(52) U.S. Cl.

CPC ..... *G07D 11/125* (2019.01); *G07F 9/06* (2013.01); *G07F 19/205* (2013.01); *G07G 1/0027* (2013.01)

(58) Field of Classification Search

CPC ..... G07D 11/125; G07D 11/009; G07F 9/06; G07F 19/205; G07G 1/0027; E05G 1/026; E05G 1/04; E05G 1/005; E06B 9/02; B65H 2701/1912

USPC ..... 232/15, 16, 1 D, 43.2; 194/350, 351, 194/206; 109/66, 73, 59 R; 902/9

See application file for complete search history.

(56) References Cited

U.S. PATENT DOCUMENTS

| | | | | |
|---|---|---|---|---|
| 2,580,752 A | | 1/1952 | Forester | |
| 3,741,464 A | * | 6/1973 | Verbeke | G07F 9/06 232/15 |
| 3,837,566 A | * | 9/1974 | McGough | G07F 9/06 232/15 |
| 3,926,366 A | | 12/1975 | Sciortino | |
| 4,456,165 A | * | 6/1984 | Sciortino | G07F 9/06 232/15 |
| 5,038,908 A | | 8/1991 | McGough | |
| 5,715,923 A | * | 2/1998 | Dekker | G07F 7/04 194/206 |
| 5,873,446 A | * | 2/1999 | Wei | G07D 11/125 194/350 |

(Continued)

OTHER PUBLICATIONS

The Search Report issued to European counterpart application No. 18150850.8 by the EPO dated Jun. 13, 2018.

*Primary Examiner* — William L Miller
(74) *Attorney, Agent, or Firm* — Hamre, Schumann, Mueller & Larson, P.C.

(57) ABSTRACT

A cashbox includes a box body with a first opening, an anti-theft plate with a second opening, and an anti-theft plate locking mechanism mounted to the box body and including a first latch member that includes a first main body pivotally connected to the box body and a latch portion extending from the first main body. The anti-theft plate is movable to an opening position, where the second opening communicates with the first opening. The anti-theft plate locking mechanism is switchable between a locking state, where the latch portion prevents the first opening from moving to the opening position, and an unlocking state, where the latch portion allows the anti-theft plate to move to the opening position.

10 Claims, 14 Drawing Sheets

(56) References Cited

U.S. PATENT DOCUMENTS

| | | | | | |
|---|---|---|---|---|---|
| 5,890,439 | A * | 4/1999 | McGunn | E05G 1/005 | 109/47 |
| 6,059,090 | A * | 5/2000 | Davis | G07B 15/066 | 194/350 |
| 6,843,409 | B2 * | 1/2005 | Park | G07D 11/125 | 232/1 D |
| 8,308,055 | B2 * | 11/2012 | Wallmann | G07D 11/12 | 232/15 |
| 8,844,705 | B2 * | 9/2014 | Braukmann | G07D 9/00 | 194/350 |
| 8,887,986 | B2 * | 11/2014 | Berendes | G07D 11/125 | 232/15 |
| 2014/0368102 | A1 * | 12/2014 | Go | A47B 81/00 | 312/294 |

* cited by examiner

SELF-LOCKING CASH DEPOSIT EQUIPMENT AND CASHBOX THEREOF

FIELD

The disclosure relates to a self-locking cash deposit equipment adapted for storing cash therein, and to a cashbox of the self-locking cash deposit equipment.

BACKGROUND

Cash, such as banknotes or coins, is widely used in people's daily life. The storage of cash in the banking business are especially important. Equipments have been developed for enhancing security of cash storage.

FIGS. 1 to 4 show a cashbox receiver 91 and a cashbox 92, which are disclosed in U.S. Pat. No. 2,580,752. The cashbox 92 can be mounted to the cashbox receiver 91 and can be used for storing cash. When the cashbox 92 is mounted to the cashbox receiver 91, a funnel 900 can be mounted to the cashbox 92 for inserting cash into the cashbox 92 therethrough.

The cashbox receiver 91 includes a top plate 911 that includes an opening 912, an abutment 913 and a spring 916. The cashbox 92 includes a first opening 922, a second opening 923 and a cash opening 924. A locking mechanism 93 is provided to locate at top side of the cashbox 92. The locking mechanism 93 includes a lever 94 that is pivotally connected to the cashbox 92, and that includes adjacent first and second protrusions 941, 942. The first protrusion 941 extends through the first opening 922 of the cashbox 92 and the opening 912 of the top plate 911. The second protrusion 942 extends through the second opening 923 of the cashbox 92.

Referring to FIGS. 2 and 3, when the cashbox 92 is mounted to the cashbox receiver 91, the abutment 913 of the cashbox receiver 91 presses against the second protrusion 942 of the lever 94 to rotate the lever 94 counterclockwise such that the first protrusion 941 of the lever 94 is extended through the opening 912 of the top plate 911 and the spring 916 is stretched. The lever 94 is then rotated to uncover the cash opening 924, allowing a funnel wall 901 of the funnel 900 to be inserted into the cash opening 924. In such state, cash can be inserted into the cashbox 92 via the funnel 900, and the first protrusion 941 extending through the opening 912 prevents the cashbox 92 from being removed from the cashbox receiver 91.

Referring to FIG. 4, after the funnel 900 is removed, the spring 916 recovers and rotates the lever 94 clockwise to cover the cash opening 924 and to move the first protrusion 941 out of the opening 912, allowing the cashbox 92 to be removed from the cashbox receiver 91.

It is desirable in the art to develop an equipment that further enhances security of cash storage.

SUMMARY

According to a first aspect of the present disclosure, a cashbox is adapted for storing cash therein.

The cashbox includes a box body, an anti-theft plate and an anti-theft plate locking mechanism. The box body is formed with a first opening. The anti-theft plate is formed with a second opening, is mounted to the box body, and covers the first opening. The anti-theft plate is movable by an external force along a moving path to an opening position, where the second opening of the anti-theft plate is spatially communicated with the first opening of the box body so as to allow the cash to pass through the first and second openings. The anti-theft plate locking mechanism is mounted to the box body, and includes a first latch member that includes a first main body pivotally connected to the box body, and a latch portion extending from the first main body. The anti-theft plate locking mechanism is operable to switch between a locking state, where the latch portion of the first latch member is located in the moving path so as to prevent the anti-theft plate from moving to the opening position, and an unlocking state, where the latch portion of the first latch member is not located in the moving path to allow the anti-theft plate to be moved by the external force to the opening position.

According to a second aspect of this disclosure, a cashbox is adapted for storing cash therein.

The cashbox includes a box body, an anti-theft plate and an anti-theft plate locking mechanism. The box body is formed with a first opening. The anti-theft plate is formed with a second opening, is mounted to the box body, and covers the first opening. The anti-theft plate is movable by an external force to an opening position, where the second opening of the anti-theft plate is spatially communicated with the first opening of the box body so as to allow the cash to pass through the first and second openings. The anti-theft plate locking mechanism is mounted to the box body. The anti-theft plate locking mechanism is operable to switch between a locking state, where the anti-theft plate locking mechanism prevents the anti-theft plate from moving to the opening position, and an unlocking state, where the anti-theft plate locking mechanism allows the anti-theft plate to be moved by the external force to the opening position.

According to a third aspect of this disclosure, a self-locking cash deposit equipment includes a casing, a cash acceptor and a cashbox.

The cash acceptor is detachably connected to the casing. The cash acceptor includes an opening for receiving cash, a conveying path spatially communicated with the opening for conveying the cash to an end of the conveying path, and a discrimination unit disposed on the conveying path for discriminating the cash. The cashbox includes a box body, an anti-theft plate and an anti-theft plate locking mechanism. The box body is formed with a first opening corresponding to the end of the conveying path. The anti-theft plate is formed with a second opening, is mounted to the box body, and covers the first opening. The anti-theft plate is movable by an external force to an opening position, where the second opening of the anti-theft plate is spatially communicated with the first opening of the box body and the end of the conveying path. The anti-theft plate locking mechanism is mounted to the box body. The anti-theft plate locking mechanism is operable to switch between a locking state, where the anti-theft plate locking mechanism prevents the anti-theft plate from moving to the opening position, and an unlocking state, where the anti-theft plate locking mechanism allows the anti-theft plate to be moved by the external force to the opening position. The cashbox is detachably connected to the casing such that an internal space of the cashbox is spatially communicated with the first opening and the opening, allowing the cash at the end of the conveying path to pass through the first opening into the internal space of the cashbox. The casing transmits the external force to the anti-theft plate.

BRIEF DESCRIPTION OF THE DRAWINGS

Other features and advantages of the present disclosure will become apparent in the following detailed description of the embodiment with reference to the accompanying drawings, of which.

DETAILED DESCRIPTION

Figure 1:
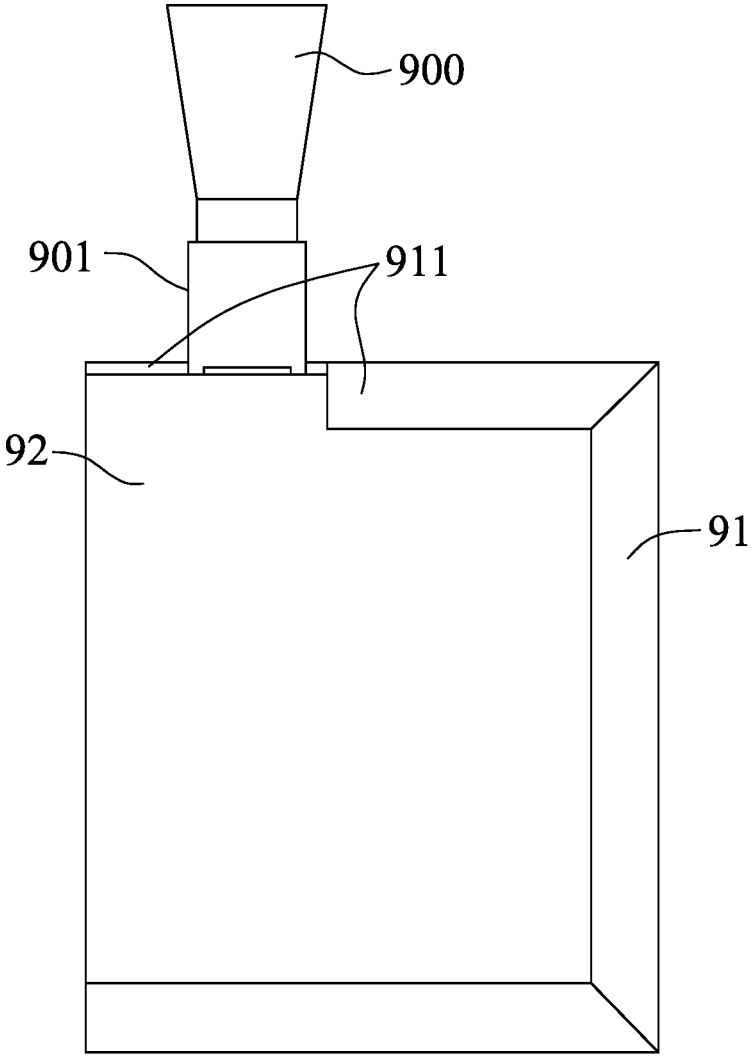
FIG.1 PRIOR ART
FIG. 1 is a side view of a cashbox receiver and a cashbox disclosed in U.S. Pat. No. 2,580,752.
Figure 2:
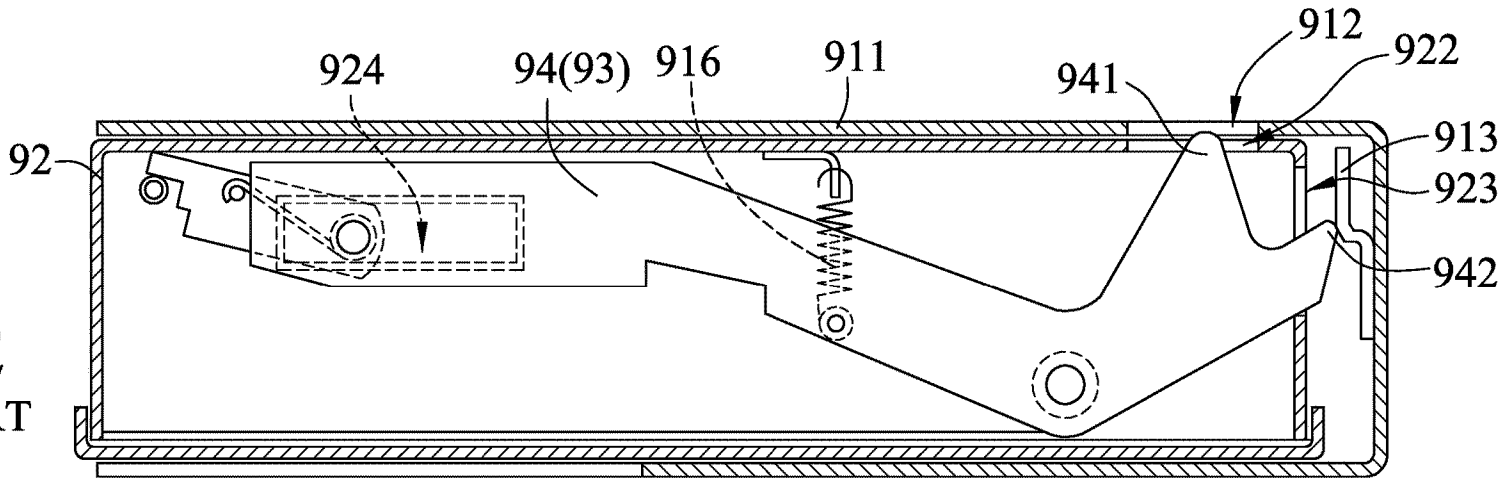
FIG.2 PRIOR ART
FIGS. 2 to 4 are schematic views showing operation of the cashbox disclosed in U.S. Pat. No. 2,580,752.
Figure 3:
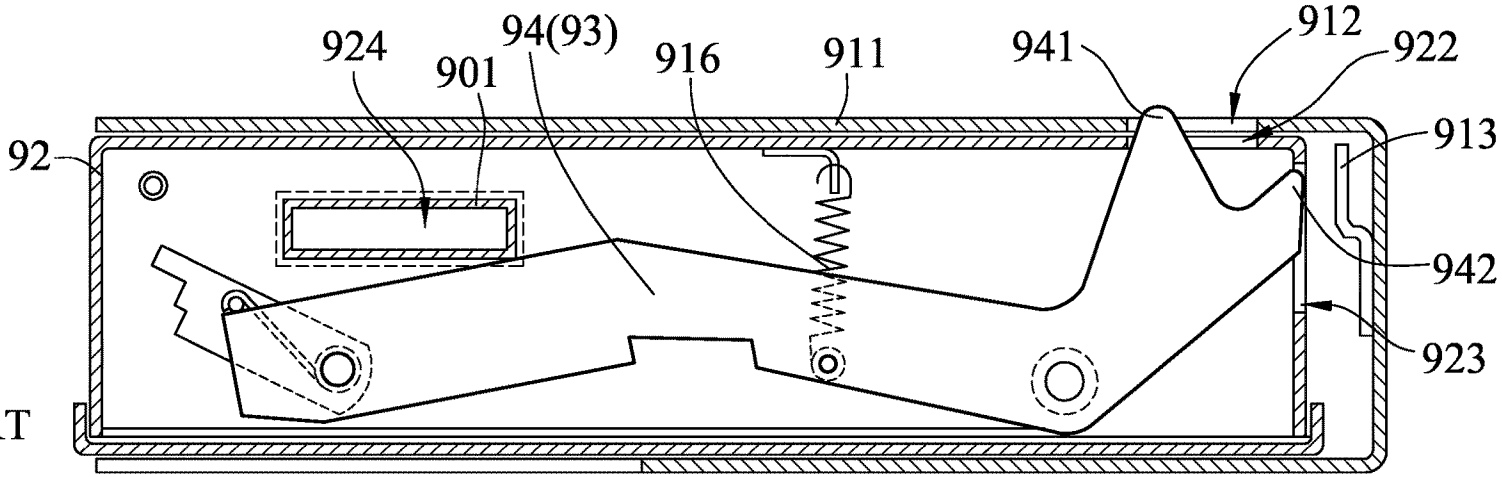
FIG.3 PRIOR ART
Figure 4:
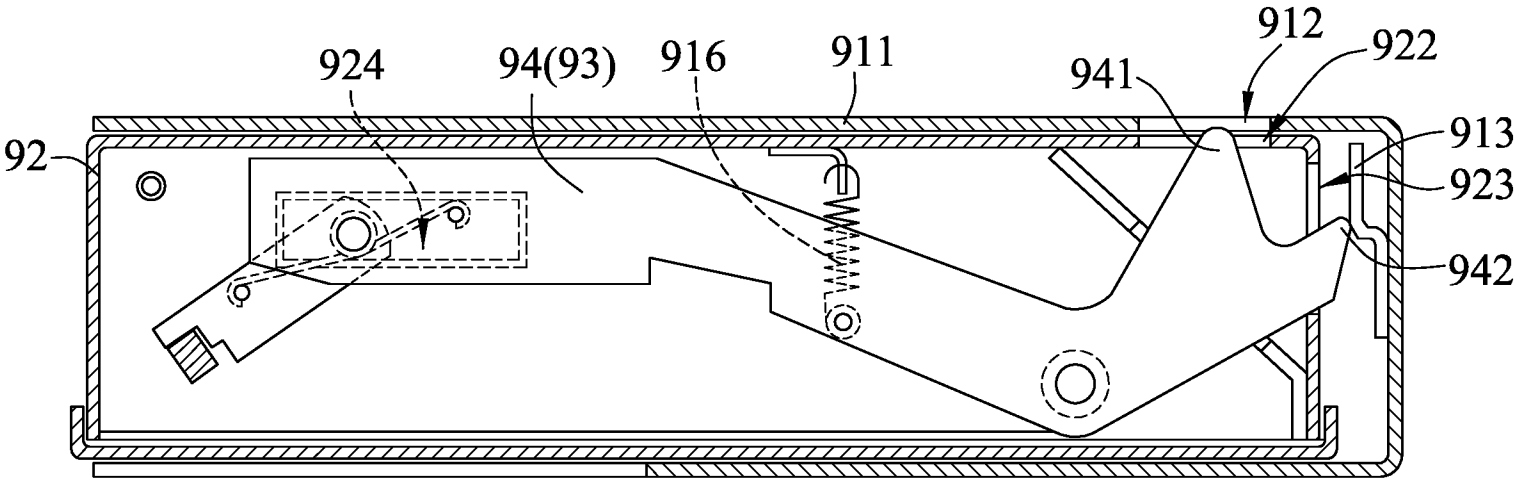
FIG.4 PRIOR ART
Figure 5:
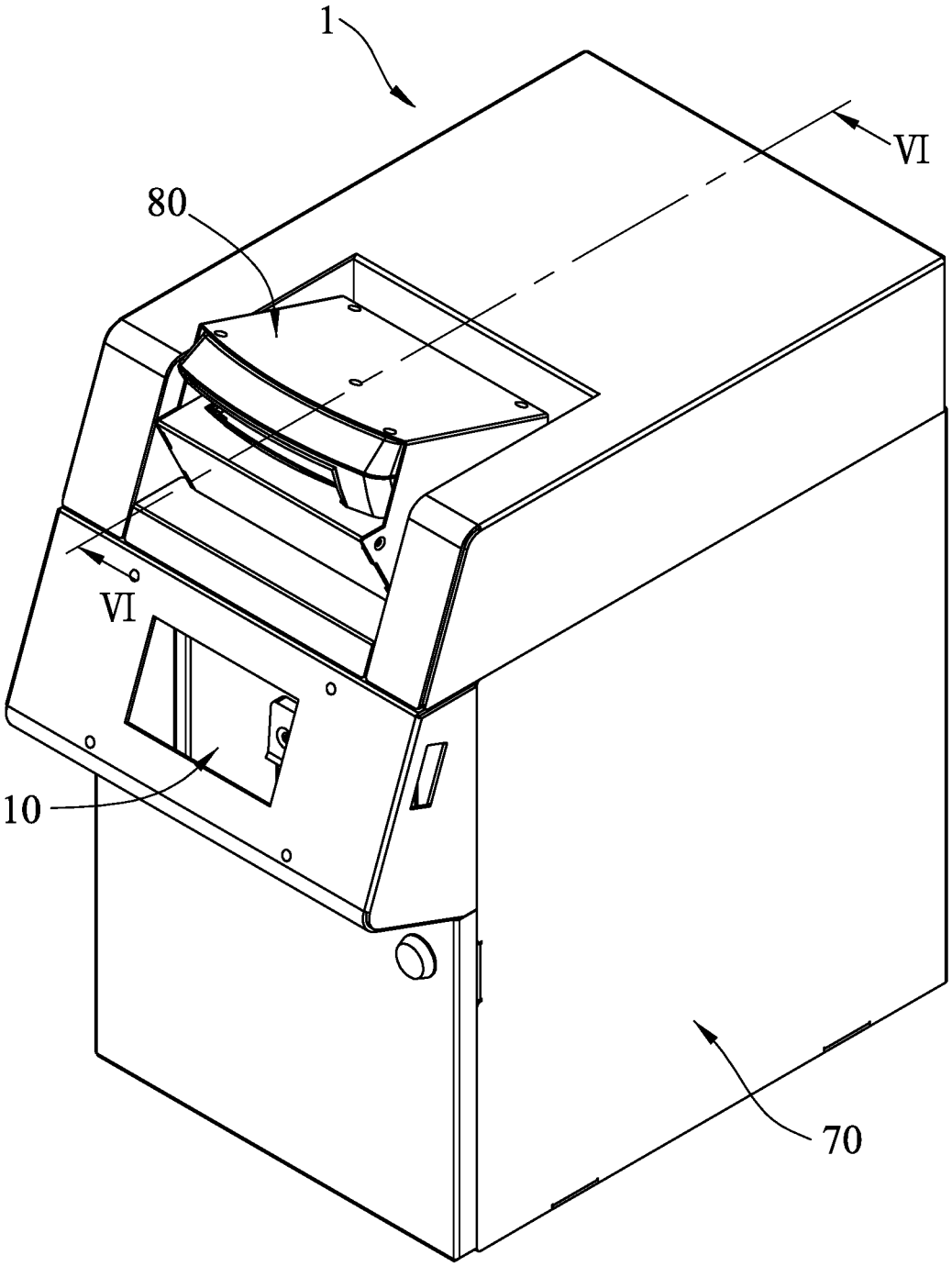
FIG. 5 is a perspective view of a self-locking cash deposit equipment according to the present disclosure.
Figure 6:
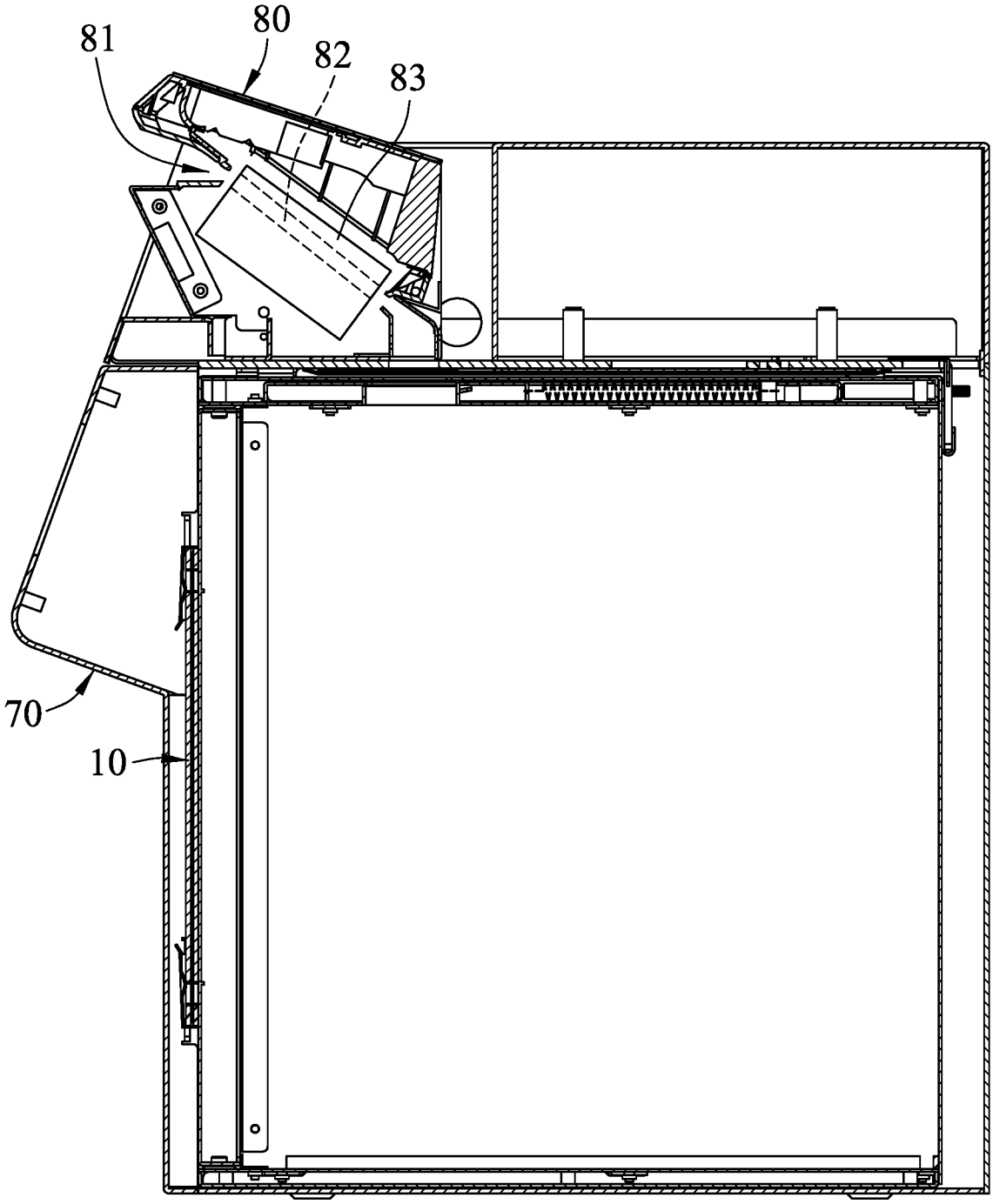
FIG. 6 is a sectional view of the self-locking cash deposit equipment according to the present disclosure taken along line VI-VI of FIG. 5.
Figure 7:
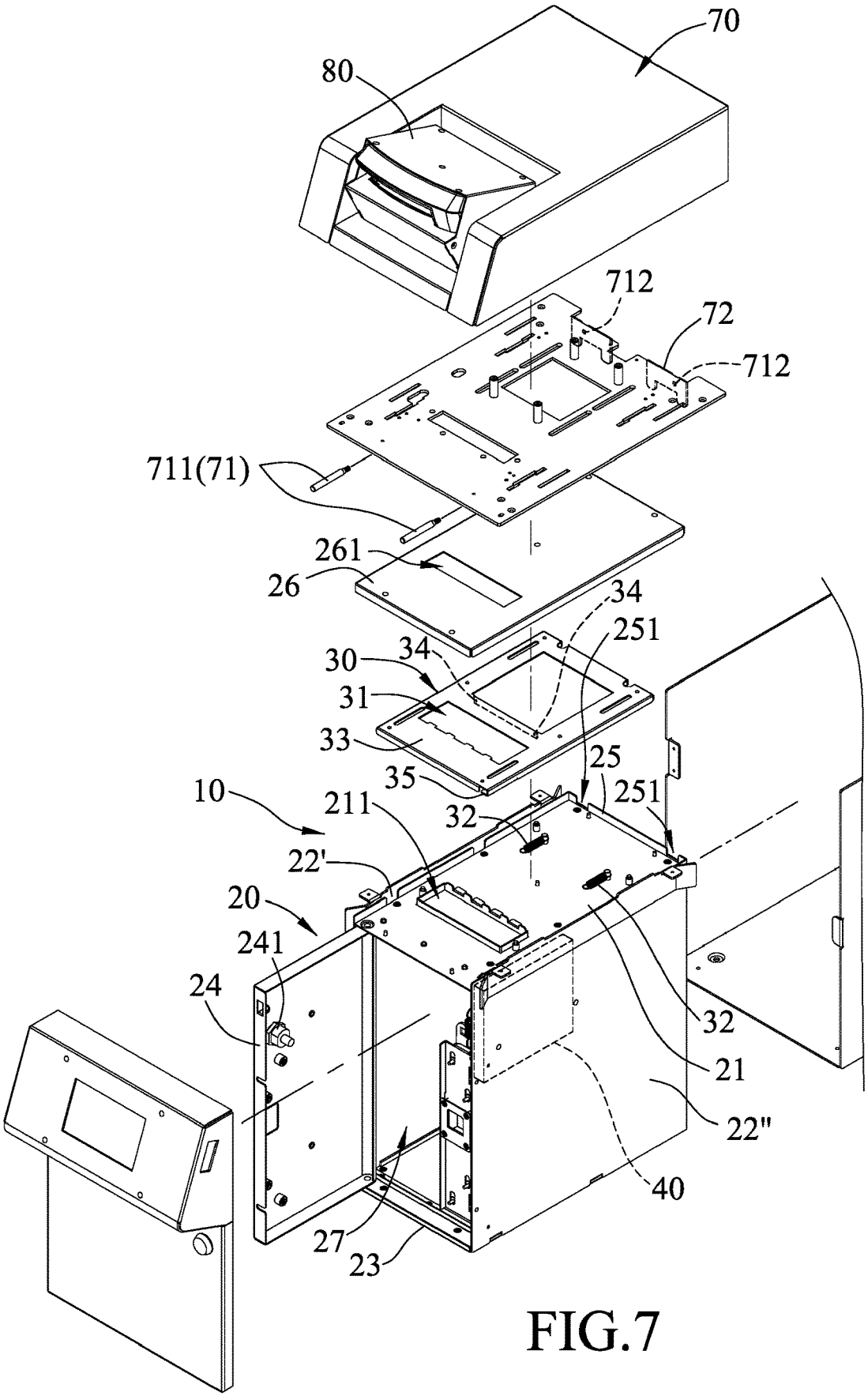
FIG. 7 is a schematic and partially exploded view of the self-locking cash deposit equipment according to the present disclosure.
Figure 8:
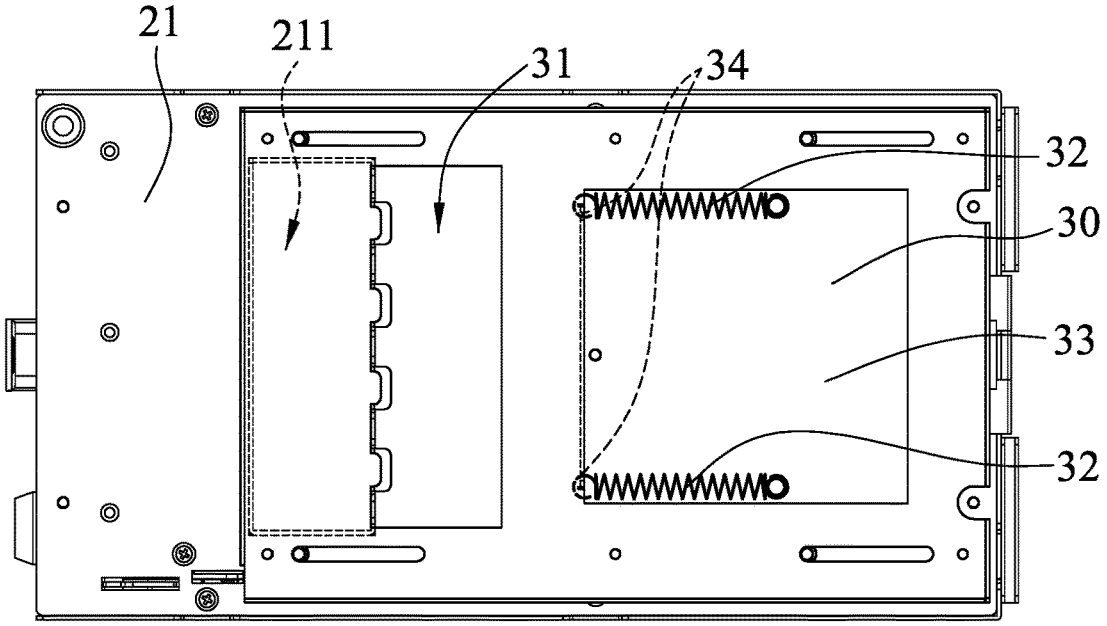
FIGS. 8 and 9 are schematic views respectively illustrating that a first opening of the self-locking cash deposit equipment is covered by and uncovered from an anti-theft plate of the self-locking cash deposit equipment.

Referring to FIGS. 5 to 7, a self-locking cash deposit equipment 1 includes a casing 70, a cash acceptor 80 detachably connected to the casing 70 and a cashbox 10 detachably connected to the casing 70 and adapted for storing cash therein. The cash may be banknotes or coins.

The cash acceptor 80 includes an opening 81 for receiving the cash, and a conveying path 82 having a front end spatially communicated with the opening 81 for conveying the cash to an end (i.e., rear end) of the conveying path 82. In this embodiment, the cash acceptor 80 further includes a discrimination unit 83 that is disposed on the conveying path 82 for discriminating the cash. The cash is inserted into the opening 81, and is discriminated by the discrimination unit 83. The cash passing the discrimination is then allowed to pass the conveying path 82 and enter the internal space of the cashbox 10. The cash failing to pass the discrimination is then returned to the opening 81. It is worth mentioning that counterfeit money, abnormal cash (such as cash with tape attached thereon), contaminated cash may fail the discrimination. In certain embodiment, a connecting unit (not shown) may be provided to connected the cash acceptor 80 to the casing 70. The cash acceptor 80 is detached from the casing 70 upon pressing a release button of the connecting unit.

Figure 9:
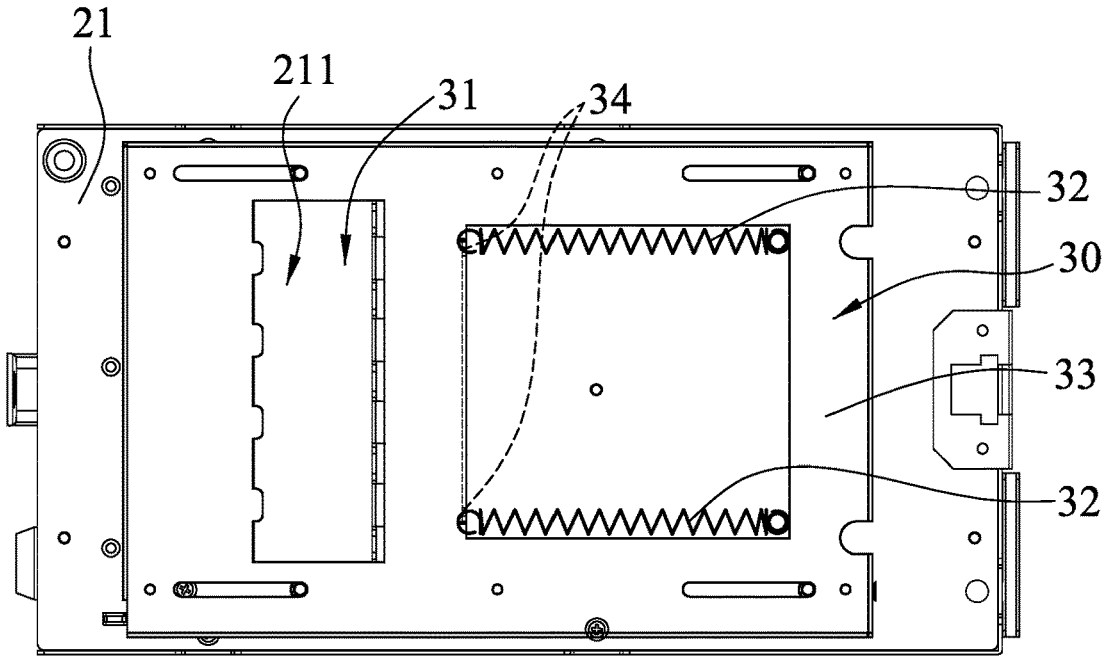

The cashbox 10 includes a box body 20, an anti-theft plate 30 and an anti-theft plate locking mechanism 40. The box body 20 is formed with a first opening 211 spatially communicated with the internal space of the cashbox 10 and corresponding to the end of the conveying path 82. The anti-theft plate 30 is formed with a second opening 31, and is mounted to the box body 20. The anti-theft plate 30 is movable by an external force along a moving path (M) (see FIG. 11) to an opening position (see FIG. 9), where the second opening 31 of the anti-theft plate 30 is spatially communicated with the first opening 211 of the box body 20 and the end of the conveying path 82 so as to allow the cash to pass through the first and second openings 211, 31 into the internal space of the cashbox 10.

In this embodiment, the box body 20 includes a rectangular top plate 21 formed with the first opening 211, two spaced apart first and second side plates 22', 22" respectively connected to long sides of the top plate 21, a bottom plate 23 connected to lower ends of the first and second side plates 22', 22", and a rear plate 25 connected to rear ends of the top plate 21, the first and second side plates 22', 22" and the bottom plate 23. The top plate 21, the first and second side plates 22', 22", the bottom plate 23 and the rear plate 25 cooperatively define the internal space and a front opening 27 formed among front ends of the top, side, and bottom plates 21, 22', 22", 23. The front opening 27 is spatially communicated with the internal space. The box body 20 further includes a front door 24 that is pivotally connected to the first side plate 22' such that the front door 24 may be operated by a user to cover the front opening 27 or to uncover the front opening 27. In this embodiment, the front door 24 is provided with a door lock 241 for locking or unlocking the front door 24 to the second side plate 22". The anti-theft plate 30 is disposed on the top plate 21. In this embodiment, the box body 20 further includes a cover plate 26 disposed on the anti-theft plate 30, and is formed with a cover plate opening 261 that is aligned with the first opening 211 of the top plate 21.

Figure 10:
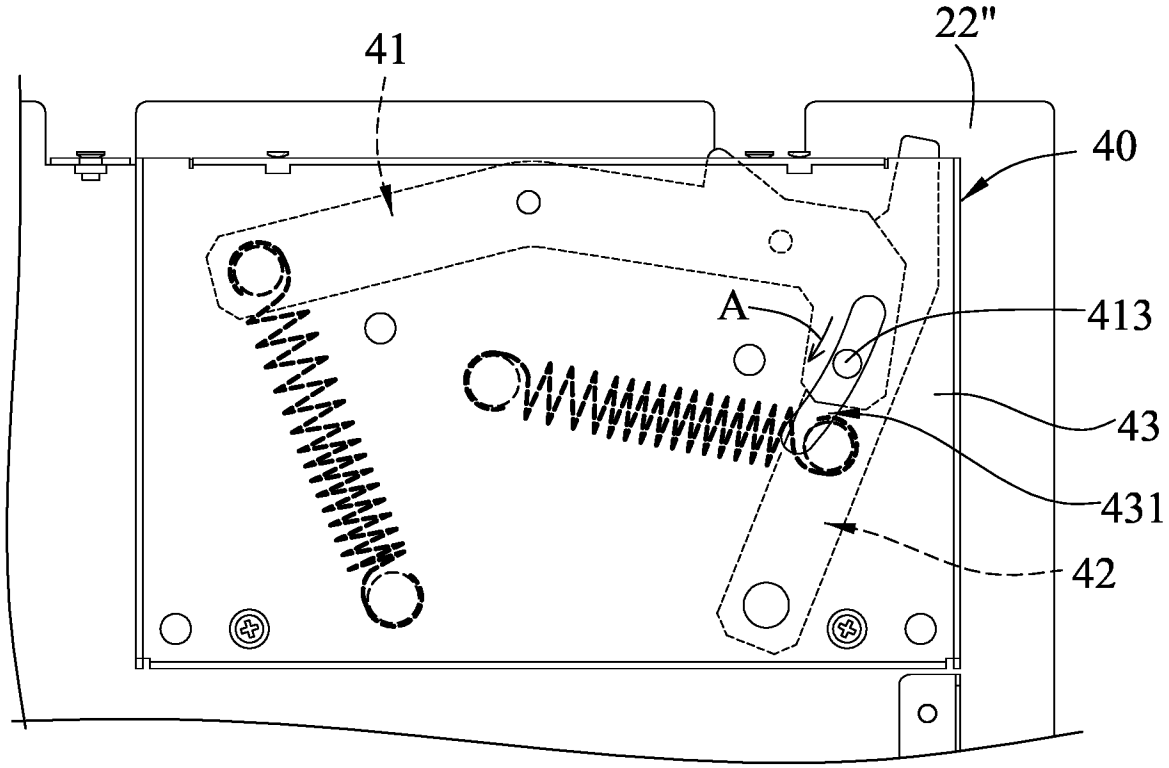
FIG. 10 is a schematic view showing inside of the self-locking cash deposit equipment, in which an anti-theft plate locking mechanism of the self-locking cash deposit equipment is shown.

The anti-theft plate locking mechanism 40 is mounted to the box body 20. Referring to FIGS. 7 and 10, in this embodiment, the box body 20 includes a cover box 43 mounted to the second side plate 22' and formed with a guiding groove 431. The anti-theft plate locking mechanism 40 is mounted to inner side of the cover box 43, and is located adjacent to the front door 24 and away from the rear plate 25.

Figure 11:
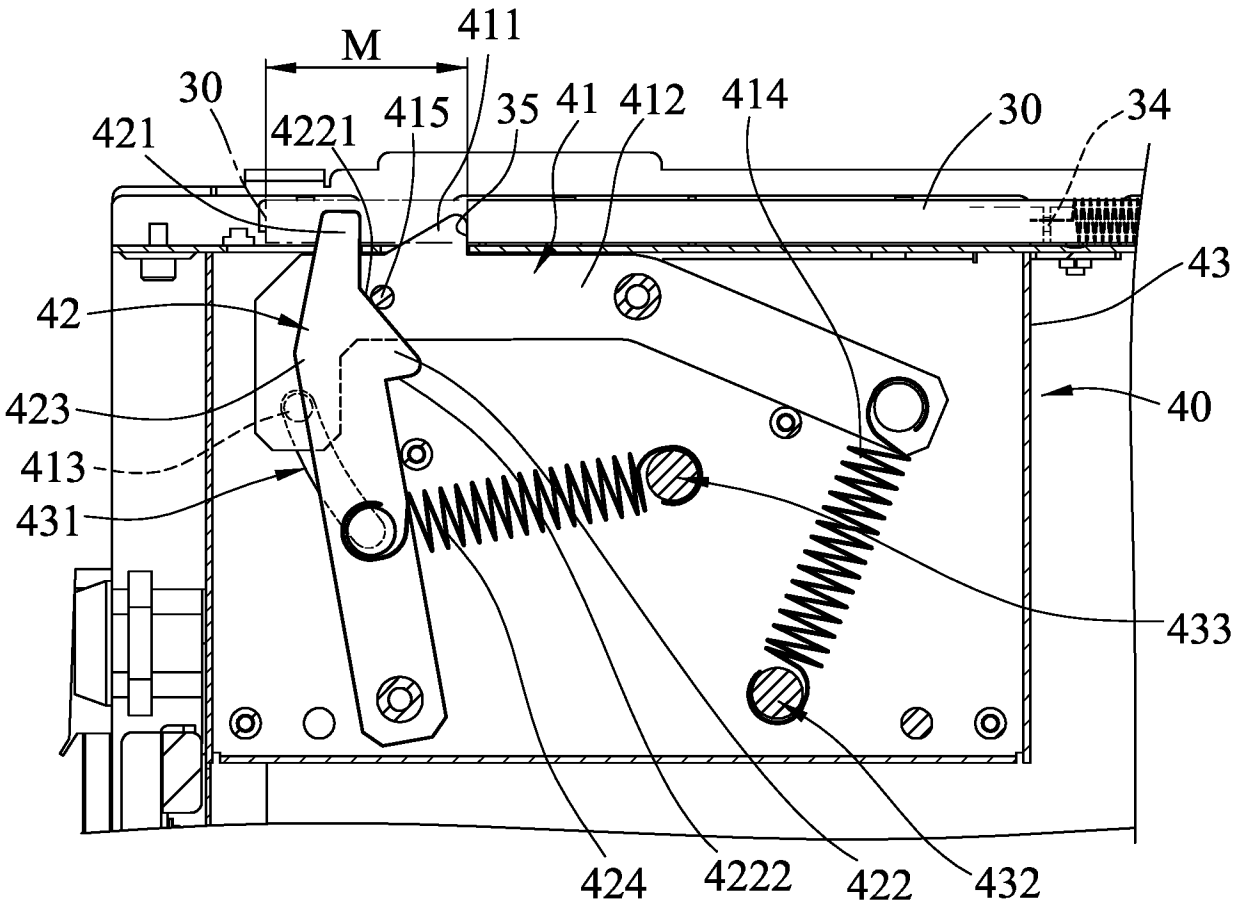
FIG. 11 is a schematic view of the anti-theft plate locking mechanism, in which the anti-theft plate locking mechanism is in a locking state.
Figure 12:
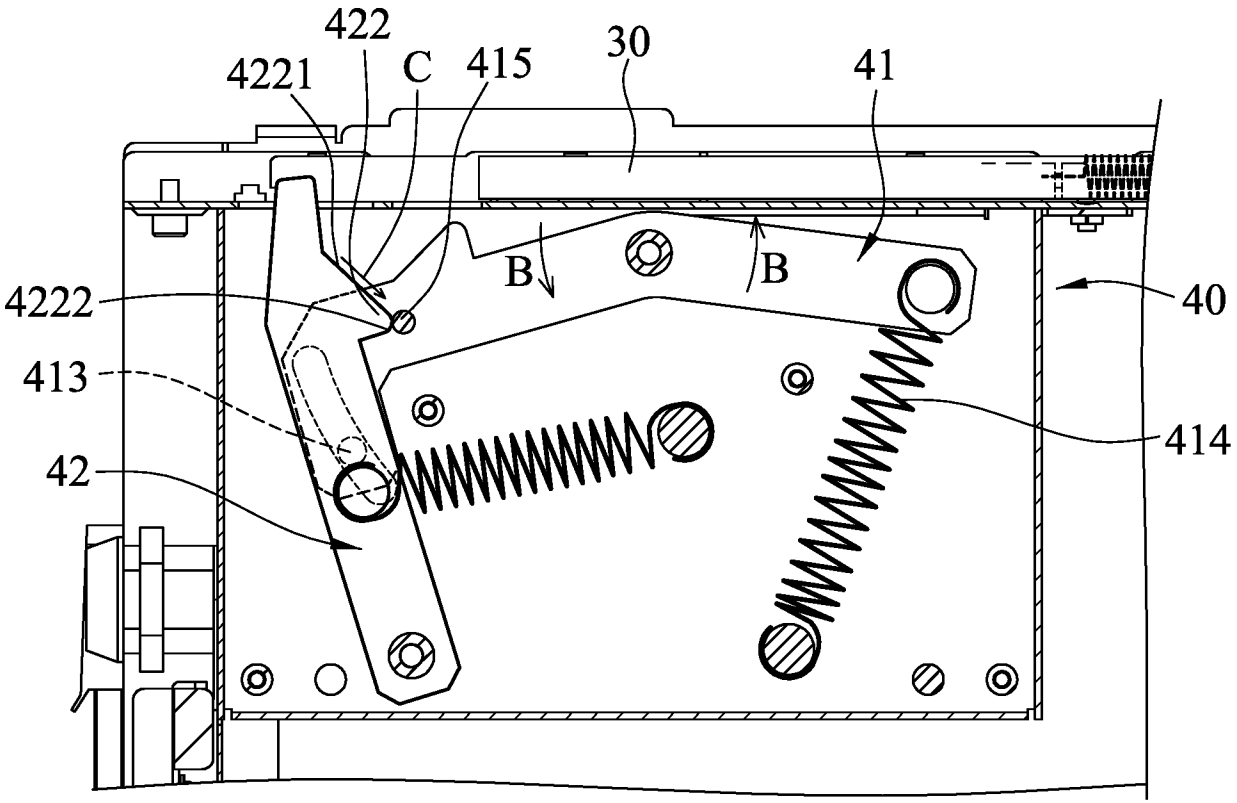
FIGS. 12 to 15 are schematic views showing operation of the self-locking cash deposit equipment.

Referring to FIG. 11, the anti-theft plate locking mechanism 40 includes a first latch member 41 that includes a first main body 412 pivotally connected to the second side plate 22" of the box body 20, a latch portion 411 extending from the first main body 412, a switching portion 413 (see also FIG. 10) formed on the first main body 412 and extending through the guiding groove 431 into the internal space of the cashbox 10, an engaging portion 415 formed on the first main body 412, and a first extension spring 414 connected between the first main body 412 and the second side plate 22". In this embodiment, the engaging portion 415 is configured as a pin. In this embodiment, the first main body 412 of the first latch member 41 substantially extends in a front-rear direction, and has opposite front and rear ends and a middle portion connected between the front and rear ends. The middle portion of the first main body 412 is pivotally connected to the second side plate 22". The first extension spring 414 is connected between the rear end of the first main body 412 and the second side plate 22". The anti-theft plate locking mechanism 40 further includes a second latch member 42 that includes a second main body 423 pivotally connected to the second side plate 22", a protrusion 421 formed on the second main body 423, a limiting portion 422 formed on the second main body 423, and a second extension spring 424 connected between the second main body 423 and the cover box 43. In this embodiment, the limiting portion 422 of the second latch member 42 is configured as a barb. The limiting portion 422 of the second latch member 42 has a guiding surface 4221, and a limiting surface 4222 opposite to the guiding surface 4221. The guiding surface 4221 is closer to the engaging portion 415 of the first latch member 41 than the limiting surface 4222. In this embodiment, the second main body 423 of the second latch member 42 substantially extends in a top-down direction, and has opposite upper and lower ends and a middle portion connected between the upper and lower ends. The lower end of the second main body 423 is pivotally connected to the cover box 43. The protrusion 421 is formed on the upper end of the second main body 423 and is located in the moving path (M). The second extension spring 424 is connected between the middle portion of the second main body 423 and the cover box 43. The limiting portion 422 is formed on the second main body 423 and is located between the protrusion 421 and the second extension spring 424. In this embodiment, the guiding surface 4221 of the limiting portion 422 is inclined with respect to a longitudinal direction of the second latch member 42, and the limiting surface 4222 is connected to the guiding surface 4221 and is perpendicular to the longitudinal direction of the second latch member 42.

Referring to FIGS. 8, 9 and 11 to 15, the anti-theft plate locking mechanism 40 is operable to switch between a locking state (see FIGS. 11 and 15), where the latch portion 411 of the first latch member 41 is located in the moving path (M) so as to prevent the anti-theft plate 30 from moving to the opening position, and an unlocking state (see FIG. 13), where the latch portion 411 of the first latch member 41 is not located in the moving path (N) to allow the anti-theft plate 30 to be moved by the external force to the opening position. When the anti-theft plate locking mechanism 40 is in the unlocking state, the first latch member 41 stores a restoring force. When the anti-theft plate locking mechanism 40 is in the unlocking state and when the external force is removed from the anti-theft plate 30, the anti-theft plate 30 is moved to cover the first opening 211 (see FIG. 8), and the anti-theft plate locking mechanism 40 is converted by the restoring force to the locking state.

Referring to FIG. 7, in this embodiment, the anti-theft plate 30 includes a plate main body 33 formed with the second opening 31 and an indentation 35 at front end thereof, and two biasing springs 32 each connected between the plate main body 33 and the top plate 21 of the box body 20. In this embodiment, the plate main body 33 is formed with two through holes 34. An end of each of the biasing springs 32 extends through a respective one of the through holes 34, allowing the biasing spring 32 to be connected to the plate main body 33. The rear plate 25 of the box body 20 is formed with two spaced apart grooves 251. The casing 70 includes a fixing frame 72, and an abutting member 71 that includes two protrusions 711 disposed on the fixing frame 72. In this embodiment, the fixing frame 72 is formed with two through holes 712, through which the protrusions 711 respectively extend.

Figure 13:
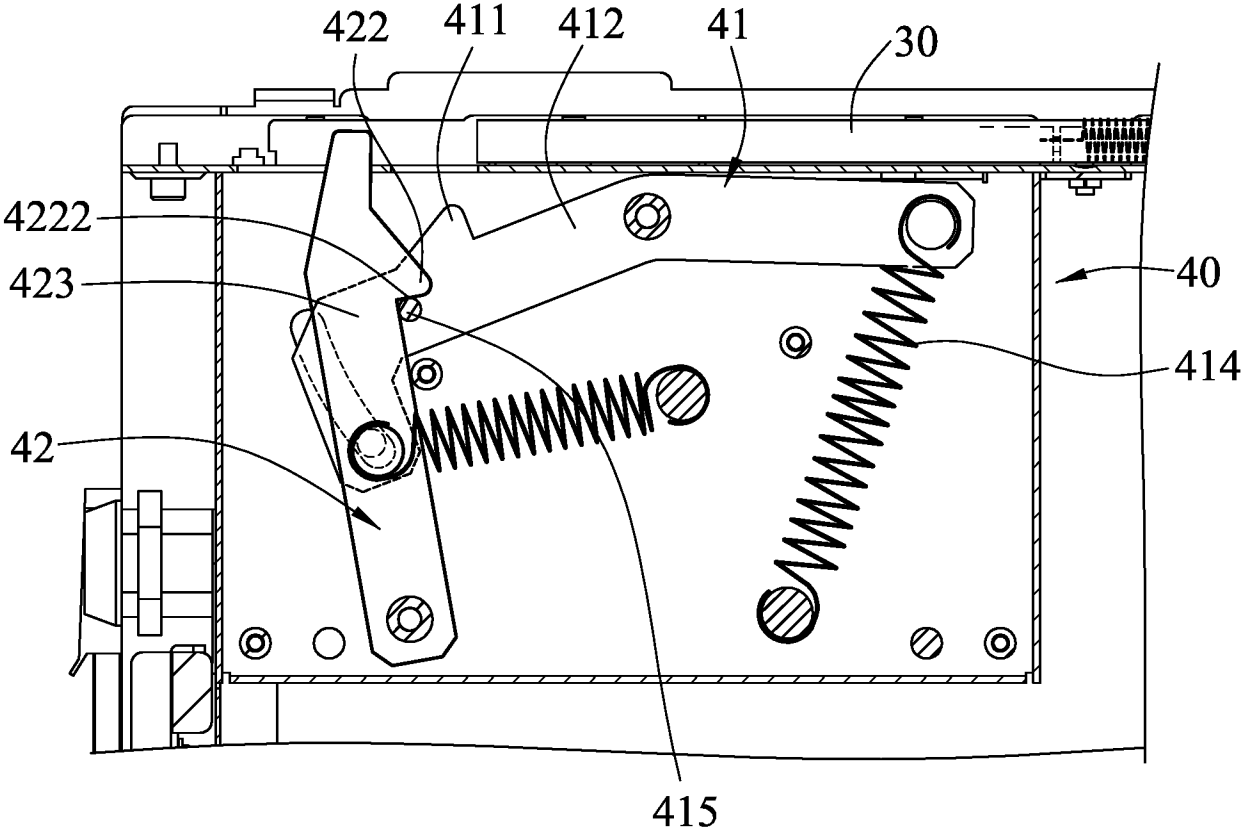
Figure 14:
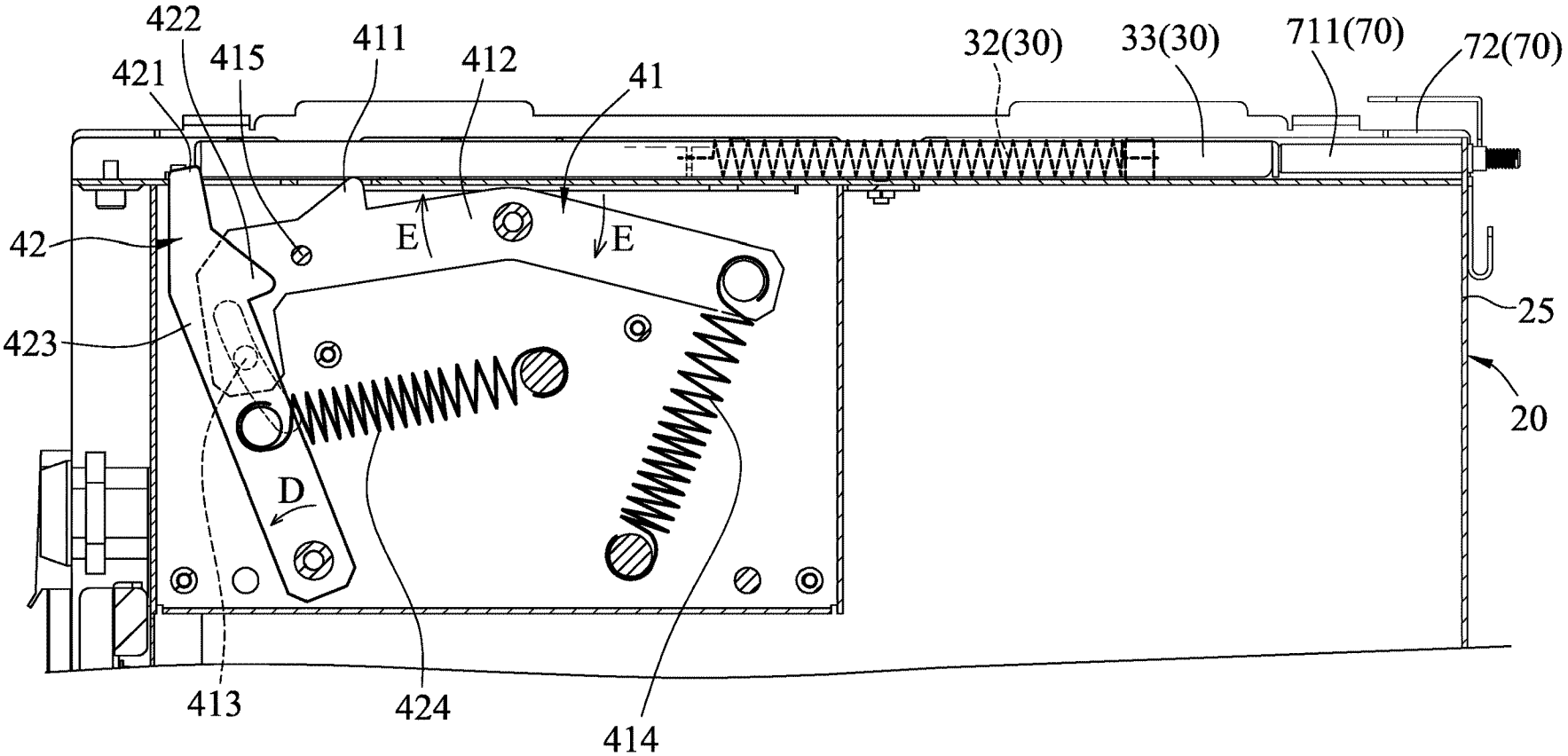

Referring to FIGS. 7 and 11 to 15, when the anti-theft plate locking mechanism 40 is in the locking state (see FIGS. 11 and 15), the latch portion 411 of the first latch member 41 is located in the moving path (M), prevents the anti-theft plate 30 from moving to the opening position. Such installation mechanism will be described in details hereinafter. The first extension spring 414 provides a biasing force to the first main body 412 to keep the latch portion 411 located in the moving path (M) when the anti-theft plate locking mechanism 40 is in the locking state. The user can use a key to unlock the door lock 241 and open the front door 24 to expose the front opening 27. The user then is able to operate the switching portion 413 of the first latch member 41 through the front opening 27. When the switching portion 413 is moved downwardly (see the arrow (A) in FIG. 10) by the user, the first main body 412 of the first latch member 41 is pivoted along a direction indicated by the arrow (B) in FIG. 12, and the engaging portion 415 of the first latch member 41 moves on the guiding surface 4221 of the limiting portion 422 of the second latch member 42 and is guided by the guiding surface 4221 along a direction indicated by the arrow (C) in FIG. 12 onto the limiting surface 4222, so as to be positioned in the box body 20 by the limiting surface 4222 (see FIG. 13). In FIG. 13, the anti-theft plate locking mechanism 40 is in the unlocking state, in which the engaging portion 415 is positioned between the second main body 423 and the limiting surface 4222 of the limiting portion 422 of the second latch member 42 and the first main body 412 of the first latch member 41 is thereby prevented from pivoting upwardly. In the unlocking state of the anti-theft plate locking mechanism 40, the first extension spring 414 stores the restoring force, and the latch portion 411 of the first latch member 41 is not located in the moving path (M). Referring to FIG. 14, when the cashbox 10 is installed to the casing 70, the protrusions 711 (only one is shown in FIG. 14) respectively extend into the grooves 251 (only one is shown in FIG. 14) of the rear plate 25 of the box body 20, and abut against the plate main body 33 of the anti-theft plate 30 to transmit the external force to the anti-theft plate 30 (i.e., the external force is exerted via the casing 70 to the anti-theft plate 30), such that the anti-theft plate 30 is moved by the external force to the opening position (see also FIG. 9), and the plate main body 33 of the anti-theft plate 30 is moved to contact the protrusion 421 of the second latch member 42, so as to push the second main body 423 of the second latch member 42 away from the engaging portion 415 of the first latch member 41, thereby removing the engaging portion 415 from the limiting portion 422 of the second latch member 42. Specifically, when the protrusion 421 of the second latch member 42 is pushed by the plate main body 33 of the anti-theft plate 30, each of the biasing springs 32 (only one is shown in FIG. 14) is stretched and stores a recovering force, the second main body 423 of the second latch member 42 pivots along a direction indicated by the arrow (D) shown in FIG. 14, the second extension spring 424 stores a return force, the first main body 412 of the first latch member 41 pivots along a direction indicated by the arrow (E) show in FIG. 14 as soon as the engaging portion 415 is released, and an upper end of the latch portion 411 abuts against a bottom side of the plate main body 33 of the anti-theft plate 30. It is worth mentioning that, to install the cashbox 10 to the casing 70, the plate main body 33 of the anti-theft plate 30 must be movable in the moving path (M). Therefore, it is not possible to install the cashbox 10 to the casing 70 when the anti-theft plate locking mechanism 40 is in the locking state since the latch portion 411 of the first latch member 41 is located in the moving path (M).

While the cashbox 10 is being installed to the casing 70, the anti-theft plate 30 is at the opening position (see also FIG. 9), and the conveying path 82 of the cash acceptor 80, the cover plate opening 261 of the cover plate 26, the second opening 31 of the anti-theft plate 30, the first opening 211 of the top plate 21 of the box body 20 and the internal space are spatially communicated, thereby allowing the cash passing discrimination to enter from the cash acceptor 80 and free fall into the internal space of the cashbox 10 (i.e., the cash acceptor 80 is located above the cashbox 10) to be stored in the cashbox 10.

Figure 15:
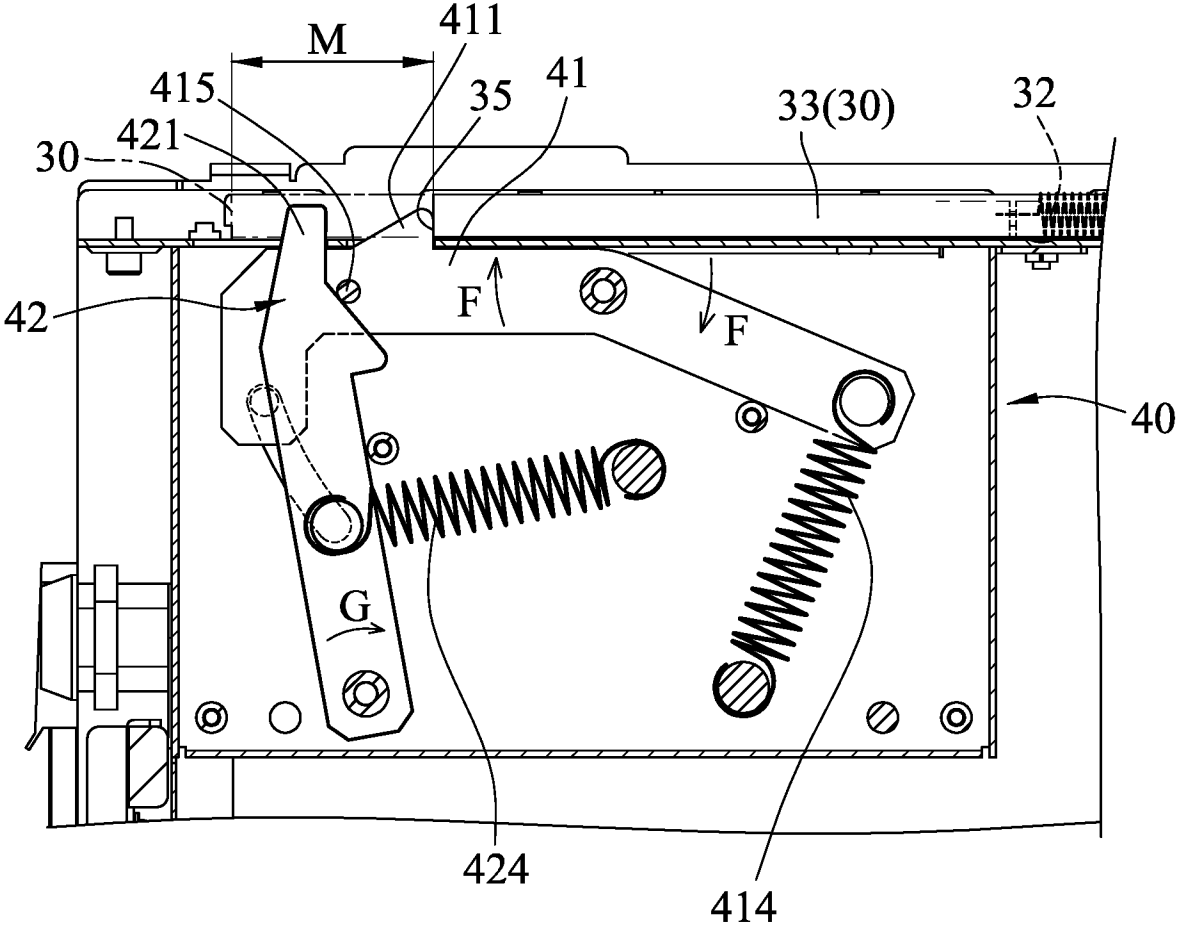

After the cashbox 10 stores a desired amount of cash, the cashbox 10 may be uninstalled from the casing 70 for further handling, such as being transported to a bank. Referring to FIG. 15, when the cashbox 10 is uninstalled from the casing 70, the protrusions 711 (not shown in FIG. 15) of the casing 70 no longer press against the plate main body 33 of the anti-theft plate 30, and each of the biasing springs 32 (only one is shown in FIG. 15) of the anti-theft plate 30 exerts the recovering force to move the anti-theft plate 30 away from the protrusion 421 of the second latch member 42 to cover the first opening 211 of the box body 20 (see FIG. 8). The first extension spring 414 exerts the restoring force to pivot the first main body 412 along a direction indicated by the arrow (F) shown in FIG. 15 such that the latch portion 411 is moved into the moving path (M), and the second extension spring 424 exerts the return force to pivot the second main body 423 along a direction indicated by the arrow (G) shown in FIG. 15 toward the engaging portion 415 of the first latch member 41. The anti-theft plate locking mechanism 40 is then returned to the locking state. Since the first opening 211 of the box body 20 is covered by the anti-theft plate 30, the cash can be safely stored in the cashbox 10.

Figure 16:
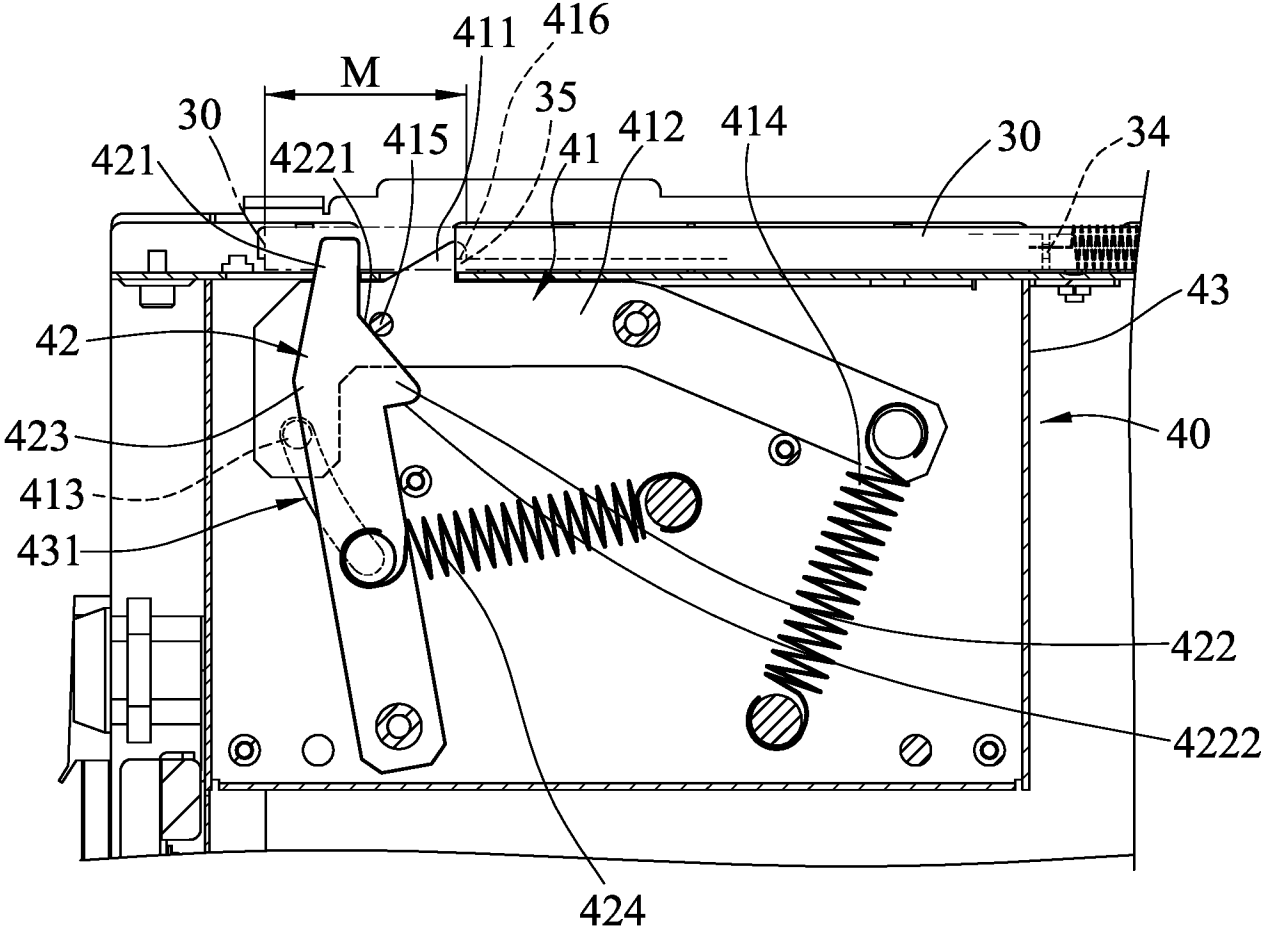
FIG. 16 is a variation of the self-locking cash deposit equipment according to the present disclosure.

Referring to FIG. 16, in a variation of the embodiment, the latch portion 411 of the first latch member 41 is configured to include a hook 416. When the anti-theft plate locking mechanism 40 is converted from the unlocking state to the locking state and the anti-theft plate 30 is moved to cover the first opening 211, the hook 416 of the latch portion 411 is engaged with the indentation 35, achieving a more state structure. It is worth mentioning that the hook 416 of the latch portion 411 will not interfere with the front end of the anti-theft plate 30 when the anti-theft plate locking mechanism 40 is being converted to the unlocking state.

The self-locking cash deposit equipment 1 of this disclosure must be operated by the user with a legit key before the cashbox 10 can be installed to the casing 70. Since the anti-theft door locking mechanism 40 is mounted to the cover box 43 on an inner side of the second side plate 22", the anti-theft door locking mechanism 40 can only be operated by the user after the front door 24 is opened by the user with the legit key. In addition, after the cashbox 10 is uninstalled from the casing 70, the anti-theft plate 30 automatically close the first opening 211 of the box body 20 of the cashbox 10, ensuring safe storage of the cash.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiment and modifications but is intended to cover various arrangements included within the spirit and scope of the broadest interpretation so as to encompass all such modifications and equivalent arrangements.

What is claimed is:

1. A cashbox adapted for storing cash therein, said cashbox comprising:

a box body formed with a first opening;

an anti-theft plate formed with a second opening, and mounted to said box body, said anti-theft plate being movable by an external force along a moving path to an opening position, where said second opening of said anti-theft plate is spatially communicated with said first opening of said box body; and an anti-theft plate locking mechanism mounted to said box body, and including a first latch member that includes a first main body pivotally connected to said box body and a latch portion extending from said first main body, wherein said anti-theft plate locking mechanism is operable to switch between a locking state, where said latch portion of said first latch member is located in the moving path so as to prevent said anti-theft plate from moving to the opening position, and an unlocking state, where said latch portion of said first latch member is not located in the moving path to allow said anti-theft plate to be moved by the external force to the opening position, wherein when said anti-theft plate locking mechanism is in the unlocking state, said first latch member stores a restoring force, wherein when said anti-theft plate locking mechanism is in the unlocking state and when the external force is removed from said anti-theft plate, said anti-theft plate is moved to cover said first opening, and said anti-theft plate locking mechanism is converted by the restoring force to the locking state, wherein said first latch member further includes a switching portion and an engaging portion that are formed on said first main body, wherein said anti-theft plate locking mechanism further includes a second latch member that includes a second main body pivotally connected to said box body, and a limiting portion formed on the second main body, wherein when said anti-theft plate locking mechanism is in the locking state, said switching portion is operable by a user such that said first main body is pivoted to remove said latch portion from the moving path, and said engaging portion contacts said limiting portion of said second latch member such that said anti-theft plate locking mechanism is limited in the unlocking state, wherein said limiting portion of said second latch member has a guiding surface, and a limiting surface opposite to said guiding surface, wherein when said switching portion of said first latch member is moved by the user, said engaging portion moves on said guiding surface, and is guided by said guiding surface onto said limiting surface, so as to be positioned in said box body by said limiting surface, wherein said first latch member further includes a first extension spring that is connected between said first main body and said box body, and wherein said first extension spring provides a biasing force to said first main body to keep said latch portion located in the moving path when said anti-theft plate locking mechanism is in the locking state, and storing the restoring force when said anti-theft plate locking mechanism is in the unlocking state.

2. The cashbox as claimed in claim 1, wherein:

said engaging portion of said first latch member is configured as a pin.

3. The cashbox as claimed in claim 1, wherein:

said limiting portion of said second latch member is configured as a barb; and said guiding surface is closer to said engaging portion of said first latch member than said limiting surface.

4. The cashbox as claimed in claim 1, said cashbox being further adapted to be installed to a casing of a self-locking cash deposit equipment, wherein:

said anti-theft plate includes a plate main body formed with said second opening, and at least one biasing spring connected between said plate main body and said box body;

said second latch member further includes a protrusion that is formed on said second main body, and a second extension spring that is connected between said second main body and said box body;

when said anti-theft plate locking mechanism is in the unlocking state and when said cashbox is installed to the casing, the external force is exerted via the casing to move said anti-theft plate to the opening position and to move said plate main body to contact said protrusion, so as to push said second main body away from said engaging portion of said first latch member such that said engaging portion is removed from said limiting portion of said second latch member and said second extension spring stores a return force; and when said cashbox is uninstalled from the casing, said at least one biasing spring moves said anti-theft plate away from said protrusion of said second latch member to cover said first opening of said box body, said first extension spring exerts the restoring force to pivot said first main body such that said latch portion is move into the moving path, and said second extension spring exerts the return force to pivot said second main body toward said engaging portion.

5. The cashbox as claimed in claim 4, wherein:

said first main body of said first latch member substantially extends in a front-rear direction, and has opposite front and rear ends and a middle portion connected between said front and rear ends, said middle portion of said first main body being pivotally connected to said box body, said first extension spring being connected between said rear end of said first main body and said box body;

said second main body of said second latch member substantially extends in a top-down direction, and has opposite upper and lower ends and a middle portion connected between said upper and lower ends, said lower end of said second main body being pivotally connected to said box body, said protrusion being formed on said upper end of said second main body, said second extension spring being connected between said middle portion of said second main body and said box body, said limiting portion being formed on said middle portion of said second main body and being located between said protrusion and said second extension spring.

6. The cashbox as claimed in claim 5, wherein:

said guiding surface is inclined with respect to a longitudinal direction of said second latch member; and said limiting surface is connected to said guiding surface and is perpendicular to the longitudinal direction of said second latch member.

7. The cashbox as claimed in claim 4, wherein:

said box body is formed with two spaced apart grooves;

the casing includes an abutting member including two protrusions; and when said cashbox is installed to the casing, the protrusions of the casing respectively engage said grooves of said box body and abut against said plate main body of said anti-theft plate to transmit the external force to said anti-theft plate.

8. The cashbox as claimed in claim 1, wherein:

said box body includes two spaced apart side plates that cooperatively define a front opening between front ends thereof, and a rear plate connected between rear ends of said side plates;

said box body further includes a front door that is pivotally connected to one of said side plates to cover or uncover said front opening;

said anti-theft plate locking mechanism is mounted to one of said side plates, and is located adjacent to said front door and away from said rear plate; and said switching portion of said anti-theft plate locking mechanism is operable by the user through said front opening when said front opening is uncovered by said front door.

9. A self-locking cash deposit equipment comprising the cashbox as claimed in claim 1, said self-locking cash deposit equipment further comprising:

a casing; and a cash acceptor connected to said casing, and including an opening for receiving cash, a conveying path spatially communicated with said opening for conveying the cash to an end of said conveying path, and a discrimination unit disposed on said conveying path for discriminating the cash, wherein said first opening of said box body corresponds to said end of said conveying path, wherein, when said anti-theft plate is at the opening position, said second opening of said anti-theft plate is spatially communicated with said first opening of said box body and said end of said conveying path, wherein said cashbox is detachably connected to said casing such that an internal space of said cashbox is spatially communicated with said first opening and said opening, allowing the cash at said end of said conveying path to pass through said first opening into said internal space of said cashbox, and wherein said casing transmits the external force to said anti-theft plate.

10. The cashbox as claimed in claim 1, wherein:

said anti-theft plate is formed with an indentation;

said latch portion of said first latch member includes a hook; and said hook is engaged with said indentation when said anti-theft plate locking mechanism is switched from the unlocking state to the locking state and said anti-theft plate is moved to cover said first opening.

* * * * *